US005951049A

United States Patent [19]

Calverley et al.

[11] Patent Number: 5,951,049

[45] Date of Patent: Sep. 14, 1999

[54] WHEEL CHOCK FOR IN-LINE SKATE

[76] Inventors: Susan Calverley, 110 Glencairn Avenue, Toronto Ontario, Canada, M4R 1M9; Charles Plant, 110 Glencairn Avenue, Toronto Ontario, Canada, M4R 1W9; Edmond Rampen, 260 King Street, Oakville, Ontario, Canada, L6E 1B7

[21] Appl. No.: 08/555,631

[22] Filed: Nov. 9, 1995

[51] Int. Cl.[6] ..... A63C 17/20

[52] U.S. Cl. ..... 280/825; 188/4 R

[58] Field of Search ..... 280/7.13, 810, 280/825; 188/4 R; 36/132, 135

[56] References Cited

U.S. PATENT DOCUMENTS

| | | | |
|---|---|---|---|
| 2,372,501 | 3/1945 | Lawrence | 36/132 |
| 3,574,959 | 4/1971 | Cicero | 36/135 |
| 3,861,697 | 1/1975 | Dolce . | |
| 4,045,890 | 9/1977 | D'Alessandro et al. | 36/132 |
| 4,286,397 | 9/1981 | Booty | 36/132 |
| 4,364,187 | 12/1982 | Melendez | 280/825 X |
| 5,183,292 | 2/1993 | Ragin, II . | |
| 5,236,224 | 8/1993 | Anderson et al. . | |
| 5,290,065 | 3/1994 | Kassal . | |
| 5,503,433 | 4/1996 | Lachapelle . | |
| 5,522,621 | 6/1996 | Schneider . | |
| 5,573,275 | 11/1996 | Smith et al. | 280/825 |

FOREIGN PATENT DOCUMENTS

| | | | |
|---|---|---|---|
| 2065834 | 4/1992 | Canada . | |
| 3016602 | 11/1981 | Germany | 280/825 |
| 42 33 880 | 1/1994 | Germany . | |

*Primary Examiner*—J J Swann
*Assistant Examiner*—Michael Mar
*Attorney, Agent, or Firm*—Orange Chari Pillay

[57] ABSTRACT

Attachment for an in-line skate of the kind having a plurality of linearly-aligned wheels comprising chocks which arrest rotational movement in adjacent wheels at the front of the skate and at the back of the skate. An elastomeric member biases the chocks in operative alignment and joins them so that they can be spaced from each other to receive a selected number of wheels in-between. The elastomeric member has first and second end loops which are fastened to respective ends of the associated skate.

22 Claims, 4 Drawing Sheets

WHEEL CHOCK FOR IN-LINE SKATE

FIELD OF THE INVENTION

This invention relates to an attachment for use particularly with in-line skates which have a plurality of linearly-aligned wheels, for the purpose of arresting the motion of the wheels and to thereby permit the wearer to walk without removing the skates. Commonly, such skates have a single row of at least three wheels. However, the invention may find application to skates with less than three wheels, and to skates with more than one row of wheels.

BACKGROUND OF THE INVENTION

The increasing popularity of in-line skates has manifested itself in recent years as the skates have become a choice means of transportation, even in busy city environments. The graduation from a sport/leisure item to a means of transportation has had some attendant problems. Among these, there is a need for the in-line skate enthusiast to periodically access premises in which skating is either not permitted or undesirable. Various devices have been proposed for use with such skates in order to permit the wearer to access such premises without the inconvenience of removing the skate.

Many of the devices conceived for use with in-line skates have been inspired by designs made available for use with ice skates where a similar problem has existed for many years. The devices essentially comprise a channel-shaped member which receives the wheels of the in-line skate and some releasable means of attaching the channel to the body of the skate as in, for example, U.S. Pat. Nos. 5,290,065; 5,303,955; and 5,445,415. A significant disadvantage of such devices is that the wheels of the skate are free to rotate inside the associated channel and the attachment means may permit relative motion between the skate and the device. This inevitably may compromise the safety of the wearer. Indeed, in some such devices, the "channel" is cut away to expose some of the wheels, as in U.S. Pat. No. 5,236,224, and the exposed wheels could easily come into rolling engagement with an irregular surface or a staircase, and thereby endanger the wearer.

An object of this invention is to provide an attachment for use with in-line skates which will make them suitable for walking and which, at least in part, addresses some of the afore-mentioned problems manifested in prior art devices.

SUMMARY OF THE INVENTION

In accordance with this invention, there is provided an attachment for an in-line skate of the kind having a plurality of linearly-aligned wheels and which comprises at least one chock which, in use, locates between adjacent wheels and is adapted to arrest rotational movement of the wheels. The device also includes a retainer for attaching the chock to the skate defining first and second end loops which are mounted to the chock and, in use, are fastened to respective ends of the associated skate.

BRIEF DESCRIPTION OF THE DRAWINGS

In order to better understand the invention, a preferred embodiment thereof and two variations are described below with reference to the accompanying drawings, in which.

DESCRIPTION OF THE PREFERRED EMBODIMENTS

Figure 1:
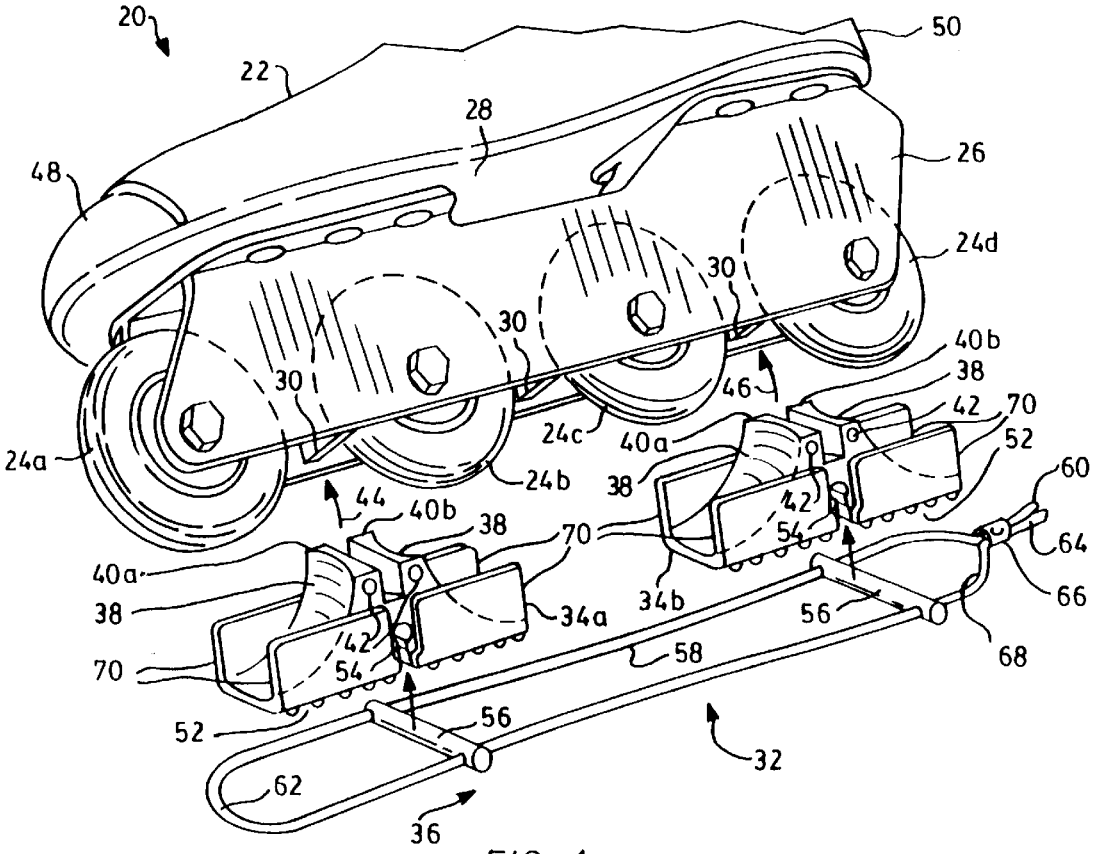
FIG. 1 is an exploded perspective view showing the component parts of an attachment made in accordance with the invention and associated with an in-line skate having four wheels.

It will be understood that the configuration of in-line skates varies considerably and that the ones illustrated in the accompanying drawings are exemplary in nature and have no limitation on the scope of the invention. An exemplary skate indicated in FIG. 1 by reference numeral 20 includes a boot 22 to which are attached four linearly-aligned wheels 24*a, b, c, d*. The wheels 24*a, b, c, d* are mounted for rotational movement between the walls of a channel-shaped skirt 26 fastened to a sole 28 of the boot 22. Three transversely-extending spacers 30 are disposed inside the skirt 26 and separate the wheels 24*a, b, c, d* from one another.

The attachment in accordance with the invention is generally indicated by reference numeral 32 and comprises a pair of chocks 34 and a retainer 36. For ease of reference, the chock disposed adjacent the toe 48 of the boot 22 will be referred to as the toe chock 34*a* while the chock disposed adjacent the heel 50 of the boot will be referred to as the heel chock 34*b*.

Each chock 34*a*, 34*b* has a pair of oppositely-disposed sloping faces 38 which are curved to a radius of curvature suitable to mate with any of the wheels 24*a, b, c, d*. In each chock 34*a*, 34*b* the sloping faces 38 are oppositely-disposed so that they will mate with respective adjacent wheels 24*a, b*; 24*c, d* of the skate 20. Between the sloping faces 38, there is a wedge-like portion 40 which in the embodiment of FIG. 1 is bifurcated into elements 40*a*, 40*b* to accommodate a spacer 30. Outwardly extending nibs 42 provided on the wedge elements 40*a*, 40*b* will engage the skirt 26 upon installation of the chocks 34*a*, 34*b* between respective adjacent wheels 24*a, b*; 24*c, d* as indicated by arrows 44, 46 adjacent the toe 48 and the heel 50.

Each chock 34*a*, 34*b* has a substantially planar bottom surface 52 which is ribbed to provide a non-slip surface and is adapted to isolate the associated wheels from a walking surface 53. A keyhole slot 54 opening to the bottom surface 52 is formed in each chock 34*a*, 34*b* and is shaped to accommodate a respective transversely-extending post 56. The posts 56 are apertured at both ends and extend outwardly from the associated chock 34*a*, 34*b* on opposite sides thereof to define support means for an elastomeric member 58.

The elastomeric member 58 is threaded through the posts 56 to define a closed loop which extends from a free end 60 (drawn to the right of FIG. 1) beneath the heel 50 of the boot through a first end of the post 56 on the heel chock 34*b* towards a first end of post 56 on the toe chock 34*a* and back through a second end of the said post 56 to form a toe loop 62 and rejoining the heel chock 34*b* at a second end of the associated post 56 where a second free end 64 of the elastomeric member 58 is joined to the first end 60 by means of a crimped bead 66 so as to form a heel loop 68. It will be understood that the posts 56 slidably receive the elastomeric member 58 so that the separation between the posts 56 may be adjusted.

Side walls 70 extend upwardly from the bottom surface 52 on each side of the chocks 34*a, b* so that, in use, they are disposed on opposite sides of a respective wheel and they extend upwardly so as to be proud of the sloping faces 38 to thereby locate the wheels 24*a, b, c, d* in the chocks 34*a*, 34*b*.

Figure 2:
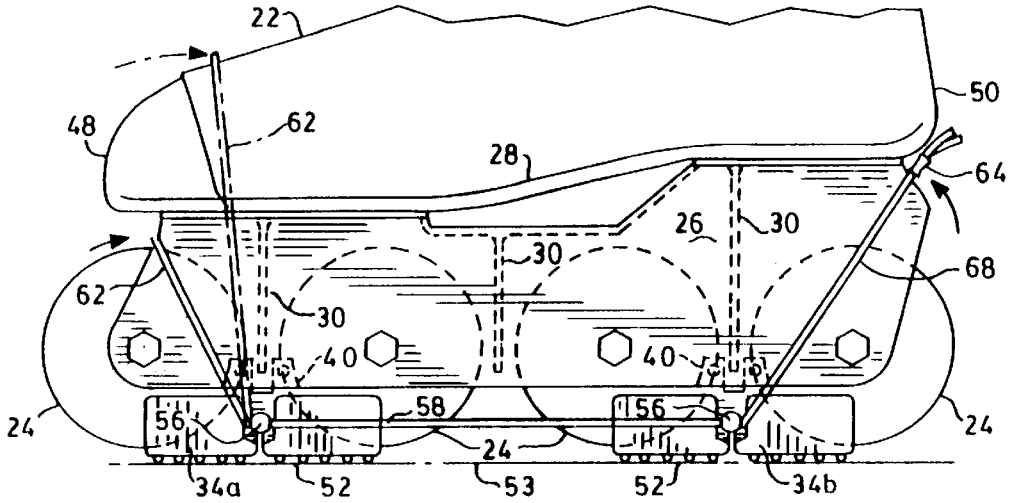
FIG. 2 is a side elevational view of the attachment drawn in FIG. 1 positioned on the skate.

The attachment 32 made in accordance with the invention is shown in its operative position in FIG. 2. It will be seen that the toe chock 34*a* has been spaced from the heel chock 34*b* by spacing their respective posts 56 along the elastomeric member 58 so as to be positioned between the first two wheels 24*a*, 24*b* and the last two wheels 24*c*, 24*d*. It will be noted that the wedge elements 40*a*, 40*b* are proud of the side walls 70 and extend upwardly between the associated wheels 24*a, b, c, d* so as to firmly abut the wheels and arrest any rotational movement thereof.

The toe loop 62 of the elastomeric member 58 is stretched over the front wheel 24*a* as shown and may, alternatively, be stretched over the toe 48 of the associated boot 22 as indicated in ghost outline in FIG. 2. The heel loop 68 is likewise stretched over the skirt 26 adjacent the heel 50. It will be appreciated that the intervening portions of the elastomeric member 58 between the toe chock 34*a* and the heel chock 34*b* are placed in tension and operate to bias the chocks in operative alignment so that there is very little likelihood of the chocks becoming disengaged from the associated wheels once the wheels have been properly aligned between the side walls 70 of the chocks.

Figure 3:
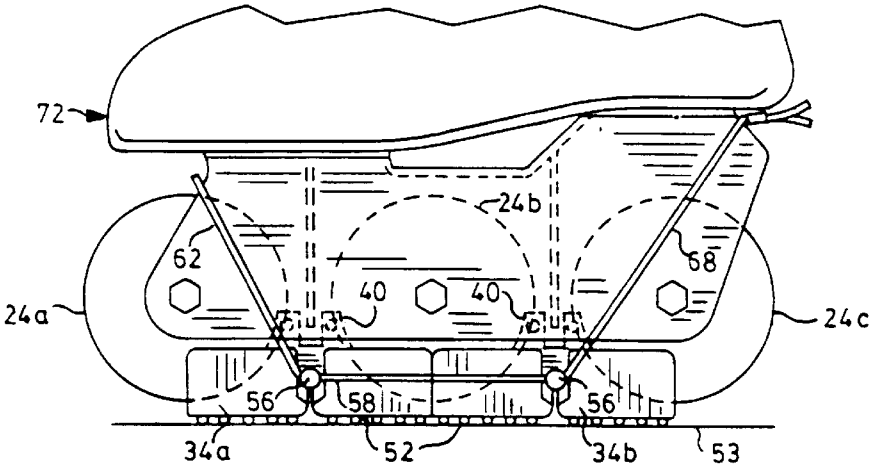
FIG. 3 is a similar view to FIG. 2 with the attachment positioned on an in-line skate having three wheels.

The same embodiment of the invention is shown in FIG. 3 in association with an in-line skate 72 having only three wheels which is more typical of the skates made for children. Like numerals have been used to identify parts corresponding to those shown in FIG. 1. Here it will be seen that the toe chock 34*a* and the heel chock 34*b* are closely spaced so that they are abutting each other, the toe chock being disposed between the front wheel 24*a* and the middle wheel 24*b* while the heel chock is disposed between the rear wheel 24*c* and the middle wheel 24*b*.

Figure 4:
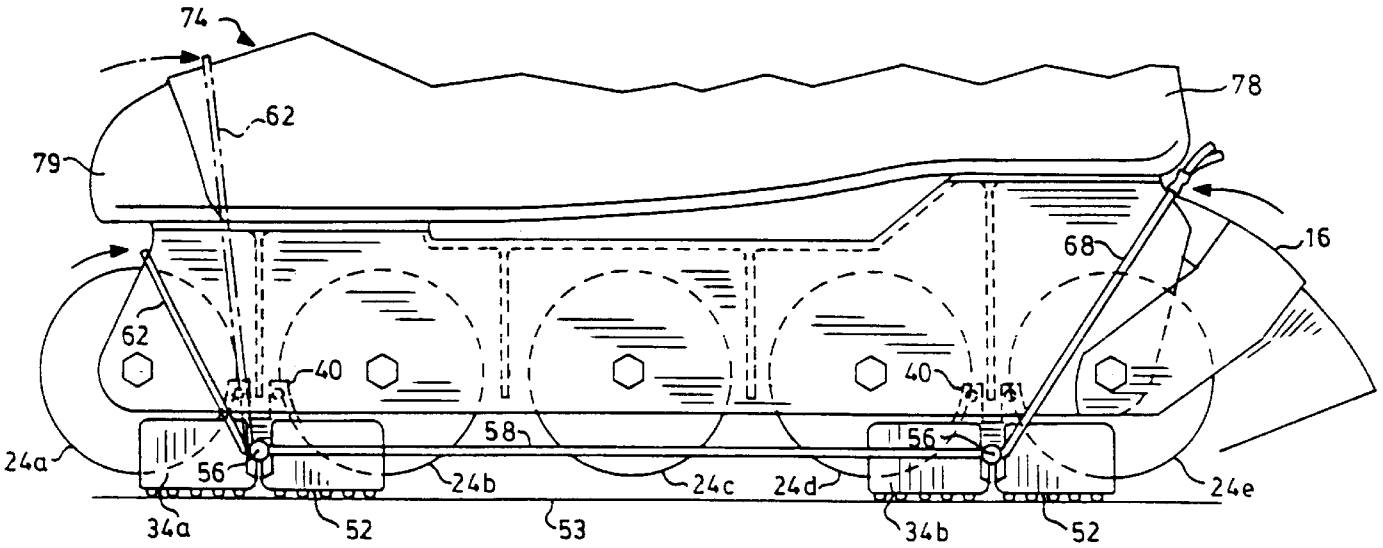
FIG. 4 is a similar view to FIG. 2 showing the attachment positioned on an in-line skate having five wheels.

The same embodiment of the invention is also adaptable for use with in-line skates having more than four wheels, as illustrated in FIG. 4 where a skate 74 has been drawn with five wheels. Here the toe chock 34*a* is disposed between the front wheel 24*a* and the adjacent second wheel 24*b*, whereas the heel chock 34*b* is disposed between the rear wheel 24*e* and the adjacent fourth wheel 24*d*, leaving the third wheel 24*c* free. In circumstances where this is not acceptable, a third chock could be incorporated into the attachment so as to positively arrest any rotational movement of a free wheel such as the third wheel 24*c* shown in FIG. 4.

It will be noted that the heel loop 68 has been stretched over a brake assembly 76 mounted beneath the heel 78 of the boot 74. The heel loop 68 is supported by the brake assembly 76 in tension so as to bias the heel chock 34*b* away from the toe chock 34*a* and upwardly in engagement with the wheels 24*d*, 24*e*. The toe loop 62 may be stretched over the front wheel 24*a* (as drawn), or over the toe 79 of the boot as shown in ghost outline in FIG. 4.

Figure 5:
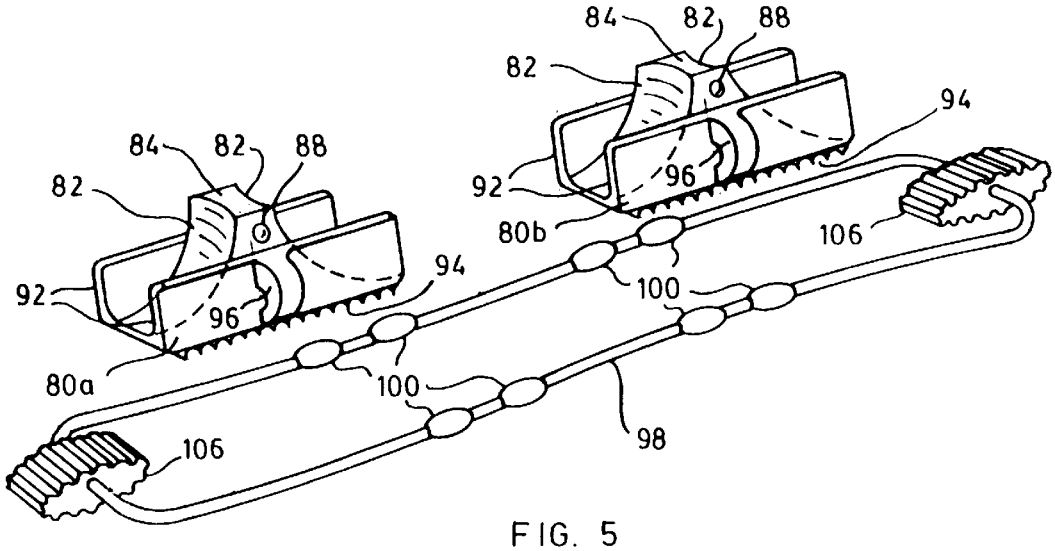
FIG. 5 is a perspective view showing the component parts of a second embodiment of the invention.

A second embodiment of the invention is shown in FIG. 5 where it will be seen that the attachment similarly comprises a toe chock 80*a* and a heel chock 80*b*, each having a pair of oppositely-disposed sloping faces 82 with a wedge 84 therebetween. The chock is for use with a skate 86 drawn in FIG. 6 where there are no spacers between adjacent wheels 87*a, b, c, d* and therefore the wedge portion 84 is not bifurcated. A friction-engaging nib 88 is provided on opposite sides of the wedge portion 84 and will, in use, abut on a skirt 90 forming part of the skate 86. Side walls 92 extend upwardly from a ribbed bottom surface 94 forming part of the chocks 80*a*, 80*b* and, together with the bottom surface may be understood as defining a U-shaped channel for locating the associated wheels 87*a, b, c, d* in the chocks.

Figure 6:
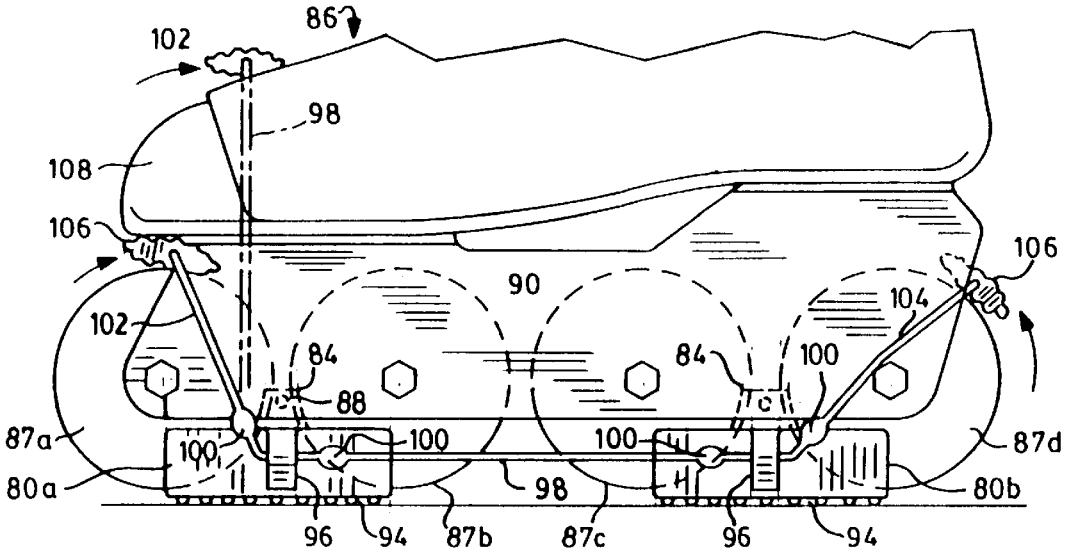
FIG. 6 is a side elevational view showing the embodiment of FIG. 5 attached to an in-line skate having four wheels.

The chocks 80*a, b* are molded from synthetic plastic material and include a pair of hooks 96 extending outwardly on opposite sides thereof, integrally molded with the chocks and adapted to slidably receive an elastomeric member 98. The elastomeric member 98 has four pairs of closely spaced integrally molded stops 100 comprising enlargements formed in the elastomeric material and adapted to receive respective hooks 96 therebetween. When the elastomeric member 98 is assembled with the chocks 80*a, b*, a toe loop 102 and a heel loop 104 are defined, similarly to the loops 62, 68 of the first embodiment shown in FIGS. 1–4. A pair of tabs 106 is provided on the elastomeric member 98, each tab being associated with a respective end loop 102, 104 and extending inwardly of the loop in order to locate between a respective end wheel 87*a*, 87*d* and the operatively bottom surface of the associated boot 108 as shown in FIG. 6. Conveniently, the tabs 106 also extend outwardly of the associated loop so that each tab may be grasped by the hand and the elastomeric member 98 may be stretched over the associated wheel 87*a*, 87*d* for the installation or removal of the attachment from the skate.

Figure 7:
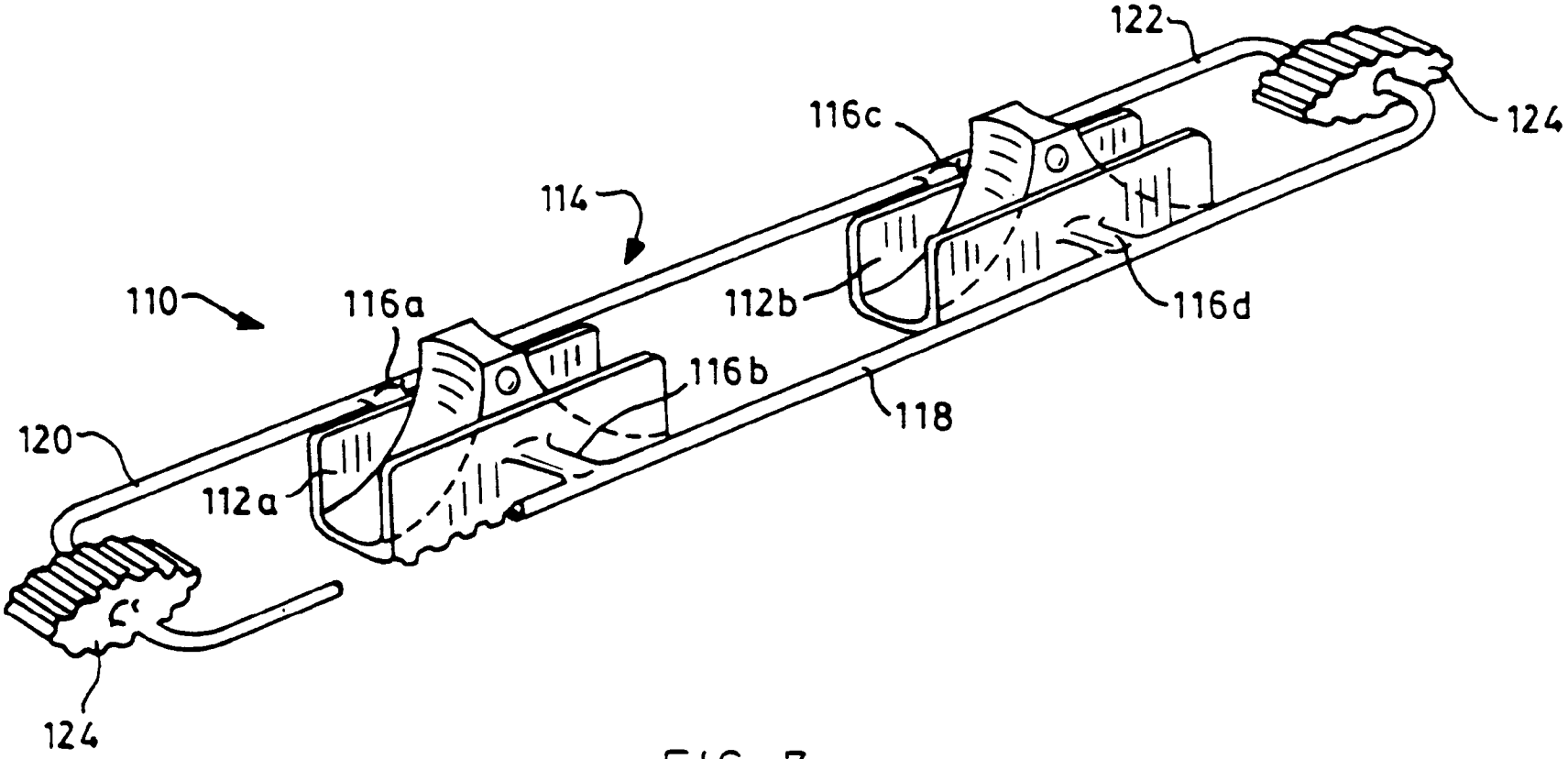
FIG. 7 is a perspective view (partly cut-away) and showing a third embodiment of the invention.

Finally, in FIG. 7, there is shown a third embodiment of the invention in which an attachment 110 comprises a pair of chocks 112*a*, 112*b* integrally formed with a retainer 114 from a suitable elastomeric material. The chocks 112*a*, 112*b* are similar to the chocks 80*a, b* drawn in FIGS. 5, 6 with the exception of the hooks 96 which have been substituted with integrally-formed, outwardly-extending webs 116*a, b, c, d*. The webs 116*a, b, c, d* terminate in an encircling band 118 which couples the chocks 112*a*, 112*b* to each other and defines a toe loop 120 at one end and a heel loop 122 at the other end, similarly to the toe loop 62 and the heel loop 68 of the embodiment shown in FIG. 1. The attachment 110 further comprises a pair of tabs 124 with one tab provided on each end loop 120, 122, similarly to the tabs 106 shown in FIG. 5. It will be understood that the attachment 110 is fabricated from a material which has sufficient elasticity to allow the spacing between the chocks 112 to vary by stretching the band 118 as required so as to match the separation between the wheels that are to be accommodated between the chocks.

Other variations as will become apparent to those skilled in the art may be made to the above-described embodiments within the scope of the appended claims. In particular, it will be appreciated that the attachment according to the invention may be fabricated to fit a designated style of skate in which the wheels have a pre-determined spacing, thereby obviating the need to adjust the separation between discrete chocks. A unitary attachment may be provided which effectively comprises one chock element with a plurality of wedgelike portions each adapted to abut on adjacent wheels. Such an embodiment may be understood with reference to FIG. 3 in which a pair of chocks 34*a, b* have been drawn abutting each other. An alternative embodiment within the scope of the claims would comprise a single chock element in which the chocks 34*a*, 34*b* are formed in one body.

Still another variation would be to provide a retainer having first and second end loops comprising straps or webbing and a suitable fastener for dosing the loops over the ends of the skate.

I claim:

1. Attachment for a in-line skate of the kind having a pair of spaced skirt members with a plurality of linearly aligned wheels mounted therebetween, said attachment comprising:

at least one chock adapted to be disposed between respective pairs of adjacent wheels and to arrest rotational movement thereof, said chock having a substantially planar bottom surface disposed in use beneath the associated wheels and adapted to isolate the associated wheels from a walking surface and including a wedge having at least one pair of oppositely-disposed sloping faces adapted to mate with respective adjacent wheels and to firmly abut the said adjacent wheels, an upper portion of said wedge adapted to be disposed between said pair of spaced skirt members, and a retainer for attaching the said at least one chock to an in-line skate mounted to said at least one chock and defining first and second end loops adapted to be fastened to respective ends of the associated in-line skate.

2. Attachment according to claim 1 in which the said bottom surface is ribbed to provide a non-slip surface.

3. Attachment according to claim 1 in which said wedge is bifurcated to accommodate a spacer disposed between adjacent wheels.

4. Attachment according to claim 1 in said wedge has outwardly extending nibs adapted to engage said skirt members.

5. Attachment according to claim 1 in which said chock has side walls disposed in use on opposite sides of a respective wheel and adapted to locate said wheel in the chock.

6. Attachment according to claim 1 in which said chock has a support member extending outwardly on opposite sides thereof and adapted to support said end loops.

7. Attachment according to claim 6 in which the support member is in the form of a transverse post apertured at both ends to slidably receive an elastomeric member therethrough.

8. Attachment according to claim 6 in which said chock, support member and an elastomeric member are integrally molded from a suitable elastomer.

9. Attachment according to claim 6 wherein said support member is releasably retained in said wedge.

10. Attachment according to claim 1 in which the support member comprises a pair of hooks integrally molded with said chock and adapted to slidably receive an elastomeric member therethrough.

11. Attachment according to claim 1 in which a locating tab is provided on each end loop, the tabs being adapted to locate between respective end wheels and an associated boot comprising the skate.

12. Attachment for in-line skates of the kind having a plurality of linearly aligned wheels comprising:

a pair of longitudinally spaced chocks each adapted to be disposed between a respective pair of adjacent wheels, each said chock having a substantially planar bottom surface disposed in use beneath the associated pair of adjacent wheels and adapted to isolate the associated wheels from a walking surface, and a wedge, including a pair of oppositely-disposed sloping faces adapted to mate with respective adjacent wheels to firmly abut the said adjacent wheels so as to arrest rotational movement thereof;

and a retainer for attaching the chocks to one another and to an in-line skate comprising an elastic member mounted to the chocks and biasing said chocks in operative alignment, said elastic member having first and second end loops adapted to be fastened to respective ends of the associated skate.

13. Attachment according to claim 12 in which the said bottom surface is ribbed to provide a non-slip surface.

14. Attachment according to claim 12 in which the wedge-like portion is bifurcated to accommodate a spacer disposed between adjacent wheels.

15. Attachment according to claim 12 in which the wedge-like portion has outwardly extending nibs adapted to engage a skirt covering for the wheels.

16. Attachment according to claim 13 in which the chocks have sidewalls disposed in use on opposite sides of a respective wheel and adapted to locate laterally said wheel in the chock.

17. Attachment according to claim 12 in which a locating tag is provided on each end loop, the tabs being adapted to locate between respective end wheels and an associated boot comprising the skate.

18. Attachment according to claim 12 in which the chocks each have support means extending outwardly on the opposite sides thereof and connected to said elastic member.

19. Attachment according to claim 18 in which the support means is in the form of a transverse post apertured at both ends to slidably receive the elastic member therethrough.

20. Attachment according to claim 18 in which the support means comprises a pair of hooks integrally molded with the chocks and adapted to slidably receive the elastometric member therethrough.

21. Attachment according to claim 18 in which the chocks, support means, and elastomeric member are integrally molded from a suitable elastomer.

22. Attachment according to claim 18 wherein said support member is releasably retained in said wedge.

* * * * *